United States Patent [19]

Christensen

[11] Patent Number: 4,532,832

[45] Date of Patent: Aug. 6, 1985

[54] DUAL-MODE RATCHET WRENCH

[76] Inventor: Wendell N. Christensen, 1304 Avondale Rd., Everett, Wash. 98204

[21] Appl. No.: 538,134

[22] Filed: Oct. 3, 1983

[51] Int. Cl.[3] ..... B25B 17/00

[52] U.S. Cl. ..... 81/57.29; 81/58.1; 81/63

[58] Field of Search ..... 81/57.29, 58.1, 60, 81/61, 62, 63, 63.1, 63.2

[56] References Cited

U.S. PATENT DOCUMENTS

| | | | |
|---|---|---|---|
| 2,723,580 | 11/1955 | Brame | 81/57 |
| 3,290,969 | 12/1966 | Bergquist et al. | 81/63.1 |
| 3,490,317 | 1/1970 | Rozmus | 81/62 |
| 3,707,893 | 1/1973 | Hofman | 81/58.1 |
| 4,003,275 | 1/1977 | Smith | 81/57.29 |
| 4,086,829 | 5/1978 | Hudgins | 81/58.1 |
| 4,099,430 | 7/1978 | Stodola | 81/58.1 |
| 4,137,801 | 2/1979 | Imperio | 81/58.1 |

*Primary Examiner*—James L. Jones, Jr.
*Attorney, Agent, or Firm*—Christensen, O'Connor, Johnson & Kindness

[57] ABSTRACT

A dual-mode ratchet wrench usable in either a reciprocating or a nonreciprocating mode is disclosed. The ratchet wrench includes a wrench body having a head portion and a handle portion, a rotatable drive unit, a ratchet mechanism, and a sleeve assembly that is axially translatable along the handle portion. In the reicprocating mode, the sleeve assembly is moved to a disengaged position wherein the wrench is operated by swinging the handle back and forth through an arcuate path. Due to the action of the ratchet mechanism, the drive unit is forced to rotate when the handle portion is swung in one direction, but not the other. In the nonreciprocating mode, the sleeve assembly is moved to an engaged position, wherein the inner end of the sleeve assembly engages the drive unit through a bevel gear system. The wrench is operated by rotating the sleeve assembly about an axial centerline through the handle of the wrench. Due to the interconnection of the sleeve assembly with the drive unit through the bevel gear system, the drive unit rotates when the sleeve assembly is rotated. A detent mechanism is included to retain the sleeve assembly in either the engaged or disengaged position.

4 Claims, 5 Drawing Figures

DUAL-MODE RATCHET WRENCH

BACKGROUND OF THE INVENTION

This invention relates to hand tools, and more particularly, to ratchet wrenches of the type having a rectangularly shaped drive lug to which an accessory tool having a complementary receptacle can be attached.

Typically, a conventional ratchet wrench has an elongate handle attached to a head portion. The head portion contains a ratchet mechanism that causes the drive lug to rotate in a selected clockwise or counterclockwise direction when the handle is repeatedly swung back and forth through an arcuate path. In particular, when a fastener such as a bolt or screw is tightened or loosened, rotational force is applied to the fastener when the handle is swung arcuately in one direction, but the ratchet mechanism allows the wrench handle to be swung in the reverse direction without rotating the drive lug in the opposite direction and, hence, without applying force to the fastener.

Conventional ratchet wrenches perform adequately in many situations. However, when the space available around the fastener head restricts arcuate movement of the handle to a relatively small angle, a conventional ratchet wrench may be unusable, or at best, cumbersome and inconvenient to use. One proposed solution to this problem is a dual-mode ratchet wrench in which the drive lug can also be made to rotate when a sleeve-like section or portion of the handle is rotated about the longitudinal axis of the handle. In such arrangements, the sleeve-like section of the handle is coupled to the drive lug by means of a shaft and bevel gear system so that rotating or twisting the handle sleeve in one direction will cause the drive lug to rotate in the clockwise direction, while rotating the handle in the opposite direction will cause the drive lug to rotate counterclockwise. Examples of such prior art dual-mode wrenches are disclosed in U.S. Pat. No. 3,707,893 issued to Hofman, and U.S. Pat. No. 4,086,829 issued to Hudgins, both of which illustrate ratchet wrenches having a rotatable handle sleeve that can be rotated to rotate the drive lug to either tighten or loosen a bolt or screw-type fastener without swinging movement of the handle.

One drawback of the prior art dual-mode ratchet wrenches results from the use of a locking mechanism for engaging and disengaging the sleeve-like handle region with the bevel gear and other elements of the associated drive system. Such a mechanism requires the person using the wrench to use both hands to perform a change in the mode of wrench operation and may require that the wrench be removed from the workpiece in order to accomplish the change. In a limited space situation, removal and replacement of the wrench from a fastener is an inconvenience and results in wasted time. Attempts have been made to provide a dual-mode wrench in which the mode of wrench operation can be selected with one hand, as illustrated by the patent to Hudgins. Such prior art arrangements of this type incorporate a ball and groove detent mechanism that allows the wrench user to slide the sleeve-like handle region between an engaged and disengaged position with one hand. A detent-type retention system wherein the detent grooves are placed in the handle drive shaft, such as the arrangement shown in the patent to Hudgins, has the drawback of weakening the drive shaft and limiting the amount of torque that can be applied to a fastener.

Accordingly, it is an object of the present invention to provide a dual-mode ratchet wrench in which a change in the mode of operation can be accomplished by use of a single hand without removing the wrench from the workpiece. A further object is to provide a ratchet wrench of the above-described type wherein the wrench will not change mode of operation in an unwanted fashion. Another object is to provide a ratchet wrench of the above-described type wherein any mechanism used to permit a single hand change in the mode of operation of the wrench does not result in weakening any of the component parts of the wrench.

SUMMARY OF THE INVENTION

These and other objects are achieved in accordance with this invention by a dual-mode ratchet wrench wherein the body of the wrench is configured to house a drive unit, a ratchet, and a rotatable sleeve assembly that cooperate to allow the wrench to operate in either a reciprocating mode, wherein a rod-like wrench handle is swung through an arcuate path to rotate a drive lug on the drive unit, or a nonreciprocating mode, wherein the drive lug is rotated by turning the sleeve assembly. The wrench body includes a head with a cylindrical aperture passing between the upper and lower surfaces of the head. Gear teeth that are part of the ratchet are formed on the inner surface of the aperture near the upper surface of the wrench head with the gear teeth oriented substantially parallel with the axial centerline of the aperture. The upper ends of the gear teeth are cut away to form a shoulder that is parallel to the upper surface of the head. The drive unit extends downwardly through the aperture and is supported by the shoulder. A drive lug formed at the lower end of the drive unit extends beyond the lower surface of the head.

The drive unit includes a spring-biased, double-ended pawl that is pivotally mounted so that teeth in the two ends of the pawl can be selectively engaged with the teeth formed in the head of the wrench, thereby forming a ratchet. When the pawl is positioned with the teeth at its first end engaged with the teeth in the wrench head, the ratchet allows a clockwise turning motion to be imparted to a bolt, screw, or other workpiece by clockwise arcuate swinging of the handle that extends away from the head of the wrench. Engagement of the pawl in this manner also allows counterclockwise rotation of the handle without applying significant rotational force to the workpiece. When the teeth on the second end of the pawl are engaged with the teeth in the wrench head, the ratchet allows counterclockwise rotational force to be applied to a workpiece and permits the handle to be freely swung in the clockwise direction. Thus, the wrench can be used in a reciprocating mode of operation when the wrench handle is repeatedly swung back and forth through an arcuate path to impart a sequence of clockwise or counterclockwise rotational forces to a workpiece.

A second mode of operation (nonreciprocating mode) is provided by a wrench constructed in accordance with this invention by sliding a sleeve that surrounds the end portion of the wrench handle toward the head of the wrench. This causes a drive shaft, which passes through a central bore of the handle, to move a pinion gear into engagement with a bevel gear that is formed in the drive unit. With the pinion and bevel gear engaged, twisting the sleeve to rotate it about the wrench handle causes the drive lug to turn and thus rotate the workpiece.

The slidable sleeve assembly used in the nonreciprocating mode of operation is selectively retained in the reciprocating, or the nonreciprocating mode position by a detent mechanism housed within the head of the wrench. The detent mechanism includes a spring-biased detent ball that is urged into an inner or outer fillet on opposite sides of a circumferential ridge that is formed on the pinion gear. The inner fillet is located so that when the sleeve assembly is in the reciprocating mode position, the detent ball is urged into the inner fillet to retain the sleeve assembly in that position. Likewise, the outer fillet is located so that when the sleeve assembly is in the nonreciprocating mode position, the detent ball will be forced into the outer fillet to prevent the sleeve assembly from changing position. Additionally, the fillets and ridge are configured so that they do not weaken the drive shaft and thereby limit the amount of torque that can be applied to a fastener or a workpiece.

While a detent mechanism is used to retain the sleeve assembly in a selected position, the retaining force of the mechanism can be overcome by one-hand operation of the person using the wrench, thereby allowing the operator to shift the dual-mode wrench between the reciprocating and nonreciprocating modes and vice-versa without removing the wrench from the workpiece on which it is being used.

BRIEF DESCRIPTION OF THE DRAWINGS

Other objects and advantages of the present invention will be apparent to one skilled in the art after reading the following description taken together with the accompanying drawings in which.

DETAILED DESCRIPTION

Figure 2:
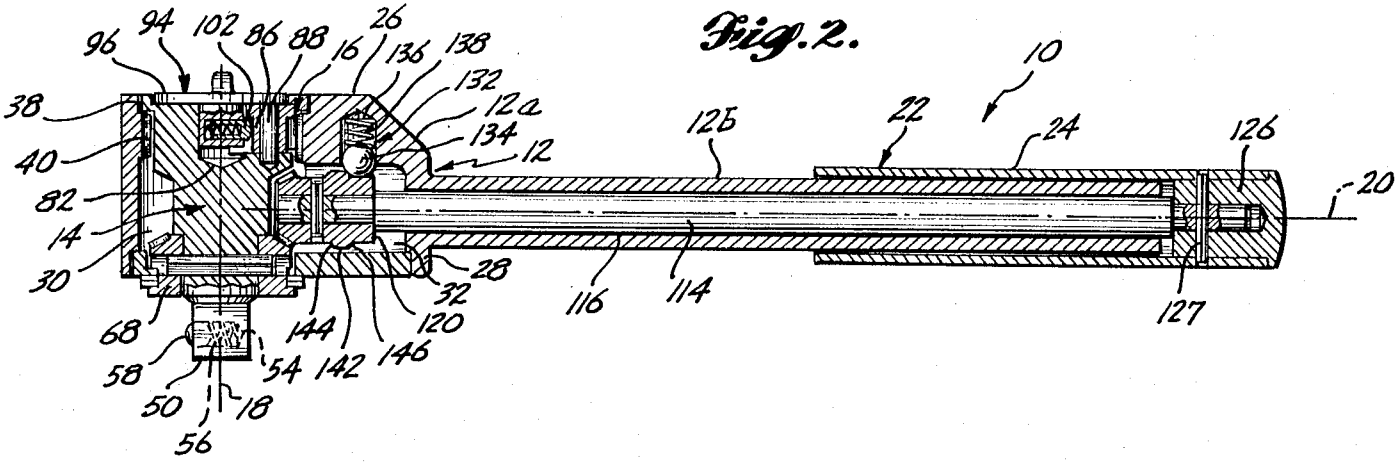
FIG. 2 is a side elevation view of the ratchet wrench of this invention with a cutaway view of the drive unit and sleeve assembly.
Figure 1:
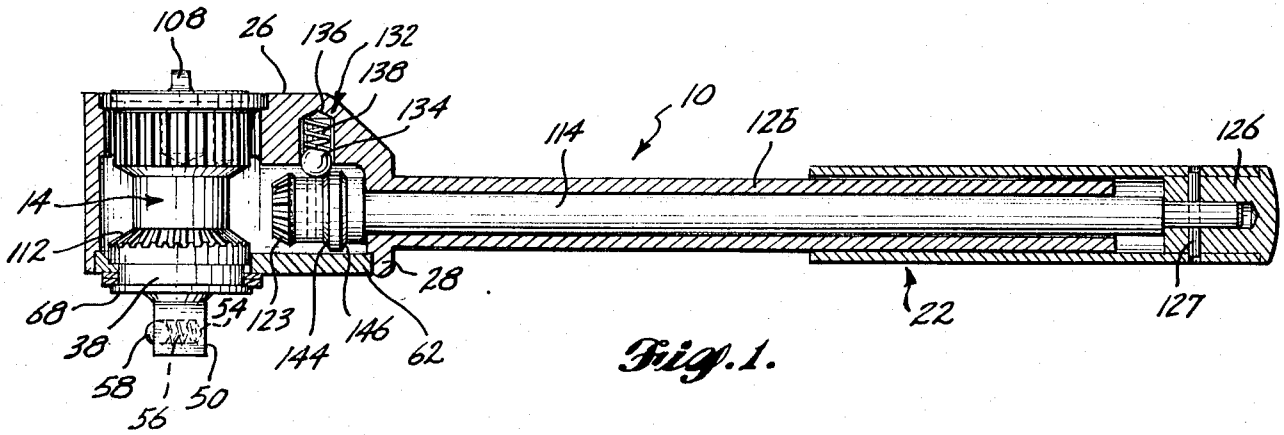
FIG. 1 is a side elevation, cross-sectional view of the ratchet wrench of this invention.

FIGS. 1 and 2 show a transverse cross section of a dual-mode ratchet wrench 10 constructed in accordance with the present invention. The wrench 10 includes an elongate wrench body 12 that has a head region 12*a* and a handle region 12*b*, both of which house or support component parts of the ratchet wrench. A drive unit 14 housed in head 12*a* contains part of a ratchet 16 that rotates drive unit 14 when handle 12*b* is swung or rotated about axial centerline 18 of drive unit 14. Centerline 18 is substantially perpendicular to axial centerline 20 of handle 12*b*. A sleeve assembly 22 is mounted on handle 12*b* and is movable toward and away from head 12*a*. Sleeve assembly 22 is in an engaged position when sleeve 24 is closest to head 12*a* and in a disengaged position when it is farthest from head 12*a*. Sleeve assembly 22 rotates drive unit 14 when sleeve assembly 22 is in the engaged position and sleeve 24 is rotated relative to handle 12*b* (i.e., rotated about axial centerline 20).

Head 12*a* has an upper surface 26 and a lower surface 28 that are spaced apart and parallel to one another. A generally cylindrical aperture 30 passes through head 12*a* between upper and lower surfaces 26 and 28 with a cavity 32 extending from aperture 30 and along lower surface 28 of head 12*a* to form a recess for containment of the terminal portion of sleeve assembly 22.

Figures 3, 4, 5:
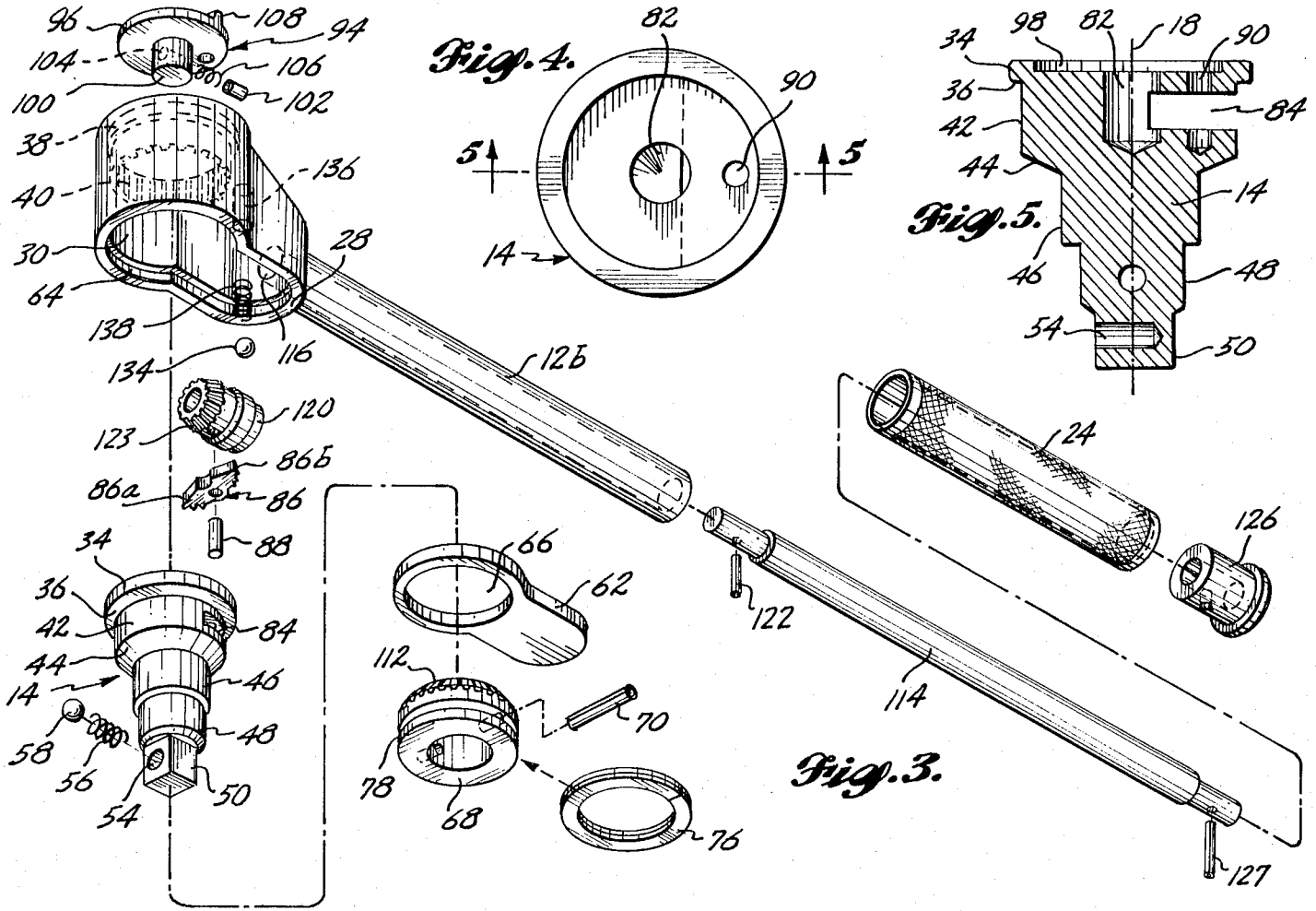
FIG. 3 is an exploded perspective view of the ratchet wrench of this invention.
FIG. 4 is a plan view of the drive unit.
FIG. 5 is a side elevation, cross-sectional view of the drive unit taken along section line 5—5 of FIG. 4.

As best shown in FIGS. 3, 4, and 5, drive unit 14 is a one-piece, multidiameter cylindrical member configured with steps of sequentially decreasing diameter from its upper to lower end. The outside diameter of first section 34 is sized to fit within aperture 30 so that the lower surface 36 of first section 34 rests upon and is supported by a shoulder 38 of aperture 30. Shoulder 38 is formed by the upper termini of teeth 40 that extend vertically along the circumference of aperture 30 and inwardly therefrom. The second section 42 of drive unit 14 extends downwardly along teeth 40 and is sized for relatively close fit rotation within the cylindrical opening defined by the inner edges of teeth 40. Second section 42 of drive unit 14 is followed by an inwardly and downwardly extending beveled section 44 that, in turn, is followed by a third section 46 having a constant diameter. Third section 46 is followed by a cylindrically shaped fourth section 48 of a diameter that is less than the diameter of the third section. A rectangular drive lug 50, to which tool accessories such as drive sockets and the like (not shown) are attached, projects downwardly from the bottom surface of fourth section 48.

To temporarily affix tool accessories such as conventional sockets to drive lug 50, drive lug 50 includes a radially extending cylindrical recess 54 configured for retaining a coil spring 56 and a friction ball 58. Coil spring 56, which is in compression between friction ball 58 and the terminal wall of recess 54, urges friction ball 58 outwardly so that a portion of the ball protrudes beyond the face of drive lug 50 (FIGS. 1 and 2). The protruding portion of friction ball 58 slides into a complementary opening or recess within the drive lug receptacle of suitably configured tool accessories, thus retaining the tool accessory on drive lug 50 until the application of a pulling force sufficient to remove the accessory.

Drive unit 14 is held in aperture 30 of head 12*a* by a retainer plate 62 that fits against a recessed shoulder 64 formed in lower surface 28 around the perimeter of the opening formed by aperture 30 and cavity 32. A circular hole 66 (FIG. 3) is formed in retainer plate 62 to fit over the outside diameter of gear member 68 that is attached to fourth section 48 of drive unit 14 by pin 70. The function of gear member 68 will be described in more detail hereinafter. When retainer plate 62 is seated against shoulder 64, a lock ring 76 is placed in a circumferential groove 78 formed in gear member 68, thus retaining drive unit 14 within wrench head 12*a* and permitting drive unit 14 to rotate about centerline 18.

As is shown best by FIGS. 2, 3, and 5, a recess 82 and slot 84 of drive unit 14 are configured to house components that operate in conjunction with teeth 40 of wrench head 12*a*. More specifically, a pawl 86 of ratchet 16 is pivotally mounted within slot 84 by means of a pin 88 that extends downwardly through a hole 90 that is formed in drive unit 14 substantially parallel to axial centerline 18. Pawl 86 is configured and mounted so that teeth that are formed at the two ends 86*a* and 86*b* of the pawl project outwardly through slot 84 and engage teeth 40 when pawl 86 is pivoted about pin 90. Since the teeth in the first end 86*a* of pawl 86 prevent counterclockwise rotation of drive unit 14 relative to wrench head 12*a* and the teeth in the second end 86*b* of pawl 86 prevent clockwise rotation, wrench 10 can be used for applying clockwise and counterclockwise force to a fastener or other workpiece by selective positioning of pawl 86 and operation of wrench 10 in the conventional, reciprocating mode.

The direction in which a workpiece can be rotated by wrench 10 is controlled by a selector assembly 94 that is installed in recess 82 of drive unit 14. Selector assembly 94 includes a circular plate 96 that is supported within a shallow recess 98 that is formed in the upper surface of drive unit 14. A solid, cylindrical projection 100, sized for rotation within recess 82, extends downwardly from circular plate 96. A push pin 102 that is installed in a radially extending blind hole 104 of cylindrical projection 100 is urged into contact with pawl 86 by a helical compression spring 106 that is positioned between the inner end of push pin 102 and the terminus of blind hole 104.

In this arrangement, rotation of a rectangular projection 108 that extends diametrically across and upwardly from the upper surface of circular plate 96 rotates selector assembly 94 within recess 82 causing the outer end of push pin 102 to press against pawl 86. When selector assembly 94 is rotated counterclockwise, push pin 102 causes the teeth in first end 86*a* of pawl 86 to engage with teeth 40 of wrench head 12*a*, thereby locking drive unit 14 relative to wrench head 12*a* during clockwise swinging movement of handle 12*b*. Rotation of selector assembly 94 in the opposite direction causes engagement of the teeth in the second end 86*b* of pawl 86 with teeth 40 to thereby lock drive unit 14 to wrench head 12*a* during counterclockwise swinging movement of handle 12*b*. Since ratchet 16 formed by pawl 86 and teeth 40 allows handle 12*b* to be swung freely in a direction opposite to that selected, wrench 10 can be used in the reciprocating mode of operation associated with conventional ratchet wrenches.

To allow wrench 10 to be used in a second (nonreciprocating) mode, gear member 68, mentioned previously, is employed. As illustrated by FIGS. 1 and 2, gear member 68 is formed with a bevel gear 112 that faces upwardly toward selector assembly 94 and is configured for engagement with the rotatable sleeve assembly 22 (when the sleeve assembly is in the engaged position with sleeve 24 moved toward head 12*a*). Sleeve assembly 22 includes a solid, cylindrical drive shaft 114 that is sized for rotation within central bore 116 of handle 12*b*. Drive shaft 114 is configured to extend completely through central bore 116 with the inner end of the drive shaft extending into cavity 32 and the outer end of the drive shaft extending from the end of handle 12*b* that is remote from wrench head 12*a*. Drive shaft 114 can slide longitudinally within bore 116 allowing sleeve assembly 22 to move between the engaged and disengaged positions.

A pinion 120 that is configured for engagement with gear member 68 is securely fastened to the inner end of drive shaft 114 by means of a pin 122 (FIG. 3) that extends transversely through pinion 120 and drive shaft 114. The inner end of pinion 120 has a gear face 123 that engages with bevel gear 112 of gear member 68 when sleeve assembly 22 is in the engaged position. To enable the wrench operator to rotate shaft 114 and pinion 120 relative to handle 12*b*, tubular sleeve 24 is sized to fit over the outside diameter of handle 12*b*. Tubular sleeve 24 is attached to the outer end of drive shaft 114 by means of a cylindrically shaped cap plug 126 that is inserted into the end of sleeve 24. A pin 127 extends radially through sleeve 24, cap plug 126, and drive shaft 114 to join these components. The outer end of cap plug 126 covers the open end of sleeve 24 as illustrated in FIGS. 1 and 2.

In the arrangement of FIGS. 1 and 2, a detent mechanism 132 located in cavity 32 maintains sleeve assembly 22 in the selected engaged or disengaged position. More specifically, a detent ball 134 extends into cavity 32 from a recess 136 that is formed in head 12*a* substantially parallel to aperture 30. A helical compression spring 138 is positioned within recess 136 and urges detent ball 134 downwardly. The receiving portion of detent mechanism 132 is formed on pinion 120. A radially extending ridge 142 circumferentially surrounds pinion 120 outward of gear face 123. In the preferred embodiment, fillets 144 and 146 formed on the inner and outer sides of ridge 142, respectively, have radii of curvature equal to the radius of detent ball 134. Ridge 142 is located so that detent ball 134 rests in inner fillet 144 when sleeve assembly 22 is in the disengaged position (FIG. 1), and in outer fillet 146 when sleeve assembly 22 is in the engaged position (FIG. 2). Thus, when sleeve assembly 22 is in the engaged position with pinion 120 in engagement with gear member 68, sleeve assembly 22 is prevented from moving outward into the disengaged position by the urging of detent ball 134 against the outer fillet 146. Likewise, when sleeve assembly 22 is in the disengaged position, the sleeve assembly is prevented from moving inward into the engaged position by the urging of detent ball 134 against inner fillet 144. By using ridge 142 on pinion 120 as part of detent mechanism 132, the torsional strength of drive shaft 114 is not decreased. Additionally, by positioning detent ball 134 above drive shaft 114, gear face 123 of pinion 120 is urged against bevel gear 112 of gear member 68 decreasing the possibility of slippage between the gears. As is illustrated in FIG. 1, cavity 32 is dimensioned so that the aft end of pinion 120 abuts the end wall of cavity 32 when sleeve assembly 22 is moved into the disengaged position, thereby acting as a stop for pinion 120.

OPERATION

To use wrench 10 in the reciprocating mode, i.e., by swinging handle 12 about centerline 18 through drive unit 14, sleeve assembly 22 is moved to the disengaged position by sliding sleeve 24 away from wrench head 12*a* so that gear member 68 and pinion 120 are not engaged (FIG. 1). The direction in which a fastener or workpiece is to be rotated is selected by rotation of selector assembly 94. If the workpiece is to be rotated in a clockwise direction, the first end 86*a* of pawl 86 is engaged with teeth 40 by rotating selector assembly 94 in a counterclockwise direction. If the workpiece is to be rotated in a counterclockwise direction, the second end 86*b* of pawl 86 is engaged with teeth 40 by rotating selector assembly 94 in a clockwise direction. Once sleeve assembly 22 has been disengaged and selector assembly 94 positioned, wrench 10 can be used as a conventional ratchet wrench.

To use wrench 10 in the nonreciprocating mode, sleeve assembly 22 is moved into the engaged position by sliding sleeve 24 toward wrench head 12*a* so that pinion 120 is engaged with gear member 68 (FIG. 2). The resistive force exerted against sleeve assembly 22 by detent mechanism 132 for preventing an unwanted change in the mode of wrench operation can be overcome by one-hand movement of sleeve 24. The direction in which a fastener or workpiece is to be rotated is selected in the same manner as when wrench 10 is used in the reciprocating mode of operation. However, in the nonreciprocating mode, rotational force is applied to the workpiece by rotating sleeve 24 about handle 12*b*, causing pinion 120 to drive gear member 68 and rotate drive unit 14.

The present invention has been described in relation to a preferred embodiment. One of ordinary skill after reading the foregoing specification will be able to effect various changes, alterations, and substitutions or equivalents without departing from the broad concepts disclosed. It is therefore intended that the scope of Letters Patent granted hereon be limited only by the definitions contained in the appended claims and the equivalents thereof.

The embodiments of the invention in which an exclusive property or privilege is claimed are defined as follows:

1. A dual-mode ratchet wrench, comprising:

a wrench body, said wrench body having a head portion and a handle portion extending from said head portion, said head portion having first and second surfaces that are spaced from and substantially parallel to one another, said head portion including an aperture passing between said first and second surfaces, said aperture being generally cylindrical and having an axial centerline passing therethrough, the inner surface of said aperture including a circumferential row of gear teeth that extend substantially parallel to said axial centerline of said aperture, said head portion having a circumferential shoulder located within said aperture intermediate said first surface and said circumferential row of gear teeth, said head portion including a cavity that opens onto said second surface and is connected to said aperture, said handle portion having a cylindrical bore extending axially therethrough with said bore intersecting said cavity;

a drive unit, said drive unit having a first end and a second end, said drive unit being retained in said aperture of said head portion of said wrench with said first end of said drive unit positioned next to said first surface of said head portion, said first end of said drive unit having a circumferential projection positioned in juxtaposition with said shoulder of said aperture, said second end of said drive unit including a drive lug extending beyond said second surface of said head portion, said drive unit being rotatable about said axial centerline through said aperture, said drive unit having a recess in the first end of said drive unit and a slot connecting said recess to the outer surface of said drive unit;

a gear member, said gear member being affixed to said drive unit intermediate the first and second ends of said drive unit, said gear member having a bevel gear formed thereon;

ratchet means for determining the direction of rotation of said drive unit relative to said wrench body, said ratchet means including a spring-biased pawl pivotally mounted within said slot in said drive unit for projection through said slot and engagement with said circumferential row of gear teeth in said aperture;

a drive shaft, said drive shaft received by and extending coaxially along said cylindrical bore of said handle portion, said drive shaft having a first end and a second end and having a length greater than said handle portion, said drive shaft being rotatable in said bore about the axial centerline of said bore, said drive shaft being movable axially within said bore between an engaged position wherein said first end of said shaft is positioned toward said aperture in said head portion and a disengaged position wherein said first end of said shaft is positioned away from said aperture;

a sleeve, said sleeve circumferentially surrounding the distal portion of said handle portion of said wrench and slidable therealong, said sleeve being connected to said second end of said drive shaft for both rotation and axial translation therewith;

a pinion, said pinion located on said first end of said drive shaft, said pinion configured for engagement with said gear member, said pinion being configured and arranged for axial and rotational movement with said drive shaft; and, a detent mechanism, said detent mechanism including a spring-biased detent ball protruding from a wall of said cavity and a circumferential detent ridge formed on the surface of said pinion, said detent ridge being configured for movement past said detent ball as said drive shaft is moved between said engaged and said disengaged positions, said detent mechanism operable to retain said drive shaft in either said engaged or said disengaged positions by means of said detent ball abutting said detent ridge, said spring-biased detent ball being positioned to urge said pinion against said gear member when said drive shaft is in the engaged position.

2. The ratchet wrench of claim 1, further comprising retainer means mountable on said second surface of said head portion for retaining said drive unit in said head portion of said wrench body.

3. The ratchet wrench of claim 2 wherein said retainer means includes a retainer plate, said retainer plate having an aperture size to fit over said second end of said drive unit when said retainer plate is in abutment with said second surface of said head portion, said retainer means further including a lock ring, said lock ring configured for attachment to said second end of said drive unit thereby holding said retainer plate in abutment with said second surface of said head portion.

4. A dual-mode ratchet wrench comprising:

a wrench body, said wrench body having a head region and a handle extending from said head region, said head region having a first surface and a second surface that are spaced apart from and substantially parallel to one another, said head region including an aperture passing between said first and second surfaces, said head region including a cavity that opens onto said second surface and is connected to said aperture, said handle having a bore extending axially therethrough with said bore intersecting said cavity;

a drive unit, said drive unit having a first end and a second end, said drive unit being retained in said aperture of said head region of said wrench with said first end of said drive unit positioned adjacent said first surface of said head region, said second end of said drive unit including a drive lug extending beyond said second surface of said head region, said drive unit being rotatable about an axial centerline through said drive unit;

a gear member, said gear member having a bevel gear formed thereon, said gear member being affixed to said drive unit intermediate the first and second ends of said drive unit;

ratchet means for determining the direction of rotation of said drive unit relative to said wrench body;

a sleeve assembly for changing the mode of operation of said ratchet wrench between a reciprocating mode and a nonreciprocating mode, said sleeve assembly including:

a drive shaft, said drive shaft being mounted to extend coaxially along said bore of said handle, said drive shaft having a first end and a second end and having a length greater than said handle, said drive shaft being rotatable within said bore and being movable axially along said bore between a first position associated with said reciprocating mode and a second position associated with said nonreciprocating mode, a sleeve, said sleeve configured to circumferentially surround the distal portion of said handle of said wrench, said sleeve being connected to said second end of said drive shaft for both rotation and axial translation therewith, a pinion, said pinion connected to said first end of said drive shaft, said pinion including a gear face configured for engagement with said bevel gear of said gear member, said pinion being configured and arranged for axial and rotational movement with said drive shaft; and, a detent mechanism, said detent mechanism including a spring-biased detent ball protruding from the inner surface of said cavity and a circumferential detent ridge formed on the surface of said pinion, said detent ridge being configured for movement past said detent ball as said drive shaft is moved between said first and said second positions, said detent mechanism being operable to retain said drive shaft in either said first or said second positions by means of said detent ball abutting said detent ridge, said spring-biased detent ball being positioned to urge said pinion against said bevel gear of said gear member when the drive shaft is in said nonreciprocating mode.

* * * * *